United States Patent [19]

Koutonen et al.

[11] 4,333,301

[45] Jun. 8, 1982

[54] ROLL WRAPPING ARRANGEMENT

[75] Inventors: Pauli Koutonen; Lars-Erik Alanco, both of Järvenpä, Finland

[73] Assignee: Oy Wartsila AB, Helsinki, Finland

[21] Appl. No.: 119,110

[22] Filed: Feb. 6, 1980

[30] Foreign Application Priority Data

Feb. 13, 1979 [FI] Finland ..... 790470

[51] Int. Cl.[3] ..... B65B 11/04

[52] U.S. Cl. ..... 53/587; 53/589; 53/211; 53/215; 100/15

[58] Field of Search ..... 53/211, 215, 587, 589; 100/15, 27, 87

[56] References Cited

U.S. PATENT DOCUMENTS

| | | | |
|---|---|---|---|
| 567,548 | 9/1896 | Owen | 100/87 X |
| 1,709,984 | 4/1929 | Kath | 53/587 X |
| 2,353,821 | 7/1944 | Fourness et al. | 100/87 X |
| 2,880,560 | 4/1959 | Gibson | 53/587 X |
| 3,207,060 | 9/1965 | Smith | 53/589 X |
| 3,715,861 | 2/1973 | Odelberg | 53/211 |
| 3,863,425 | 2/1975 | Edwards | 53/211 |
| 4,224,782 | 9/1980 | Moflag | 53/587 |

FOREIGN PATENT DOCUMENTS

| | | | |
|---|---|---|---|
| 550369 | 10/1956 | Italy | 53/215 |

*Primary Examiner*—John Sipos

*Attorney, Agent, or Firm*—McAulay, Fields, Fisher, Goldstein & Nissen

[57] ABSTRACT

An arrangement for wrapping big web rolls. The arrangement comprises a support system for supporting and rotating a web roll and a frame surrounding the web roll and having means for leading a wrapper around the roll. The frame includes a guide strap and operating means for applying the strap on the mantle surface of the roll and for keeping the wrapper between the strap and the roll. The operating means has a support position, in which it supports a portion of the guide strap at a distance from the roll, thereby causing the guide strap to bend off at a certain point from the surface of the roll. For bringing the front end of the wrapper to follow the roll, the operating means can be moved around said roll. Whereby the bending-off point of the guide strap also moves around the roll and an increasing portion of the guide strap settles on the mantle surface of the roll to keep the wrapper closely thereon when rotating the roll during simultaneous feeding of wrapper thereto.

14 Claims, 8 Drawing Figures

Figure 2:
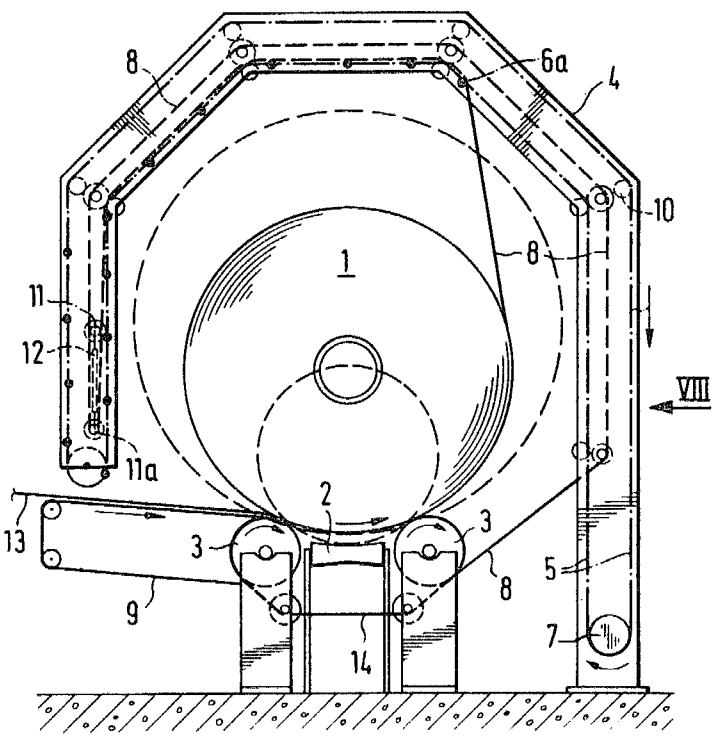

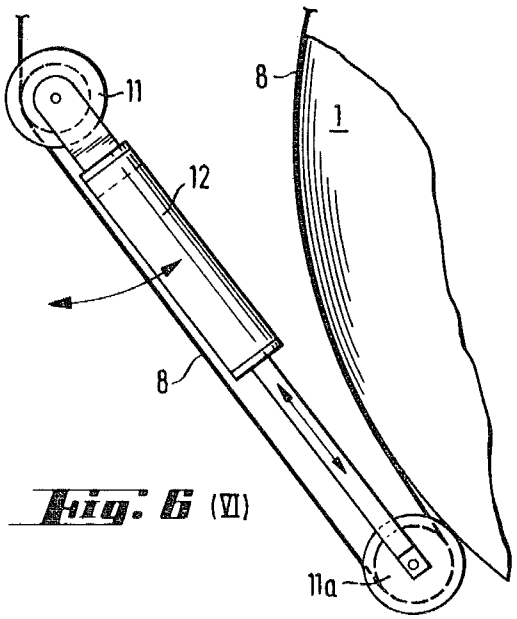
Fig. 6 (VI)
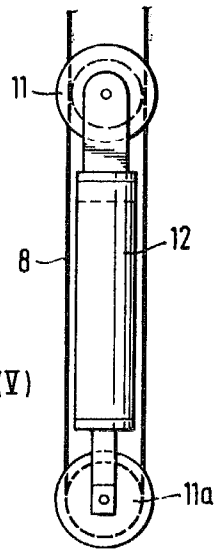
Fig. 5 (V)

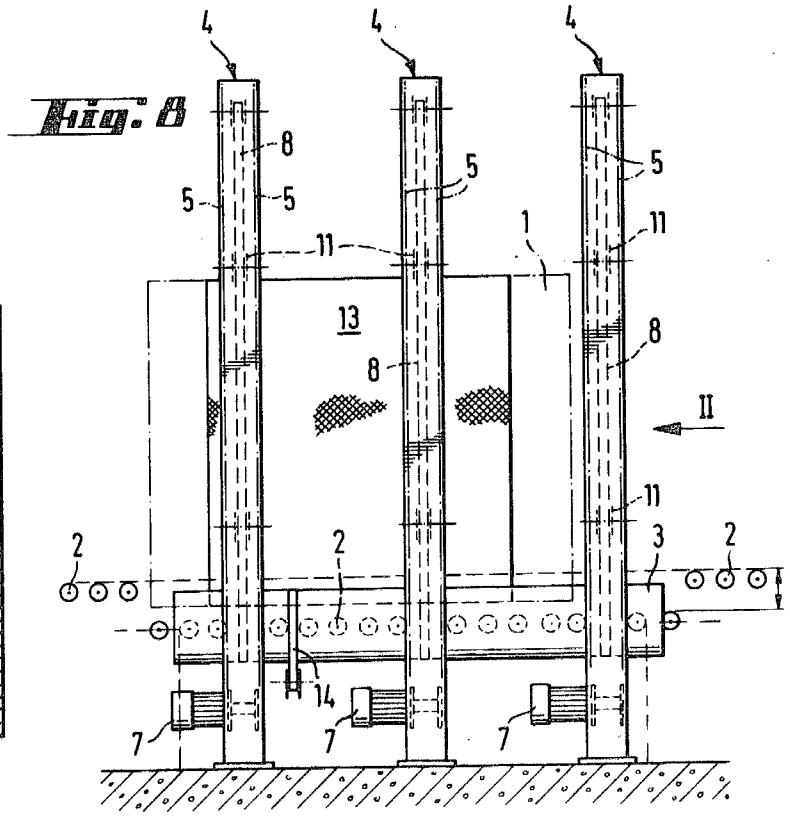
Fig. 8
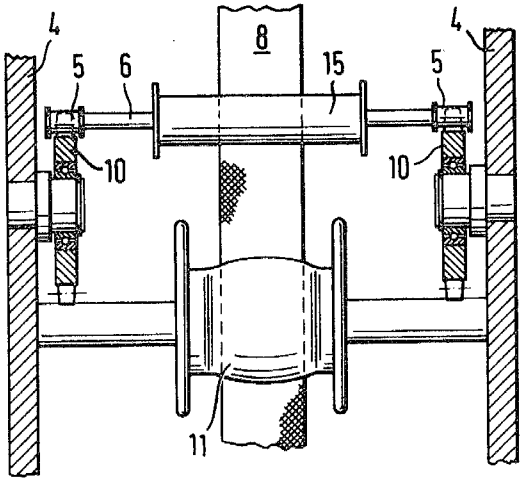
Fig. 7 (VII)

ROLL WRAPPING ARRANGEMENT

The invention relates to a wrapping arrangement for wrapping big web rolls of different diameters in a wrapper.

In known devices for the wrapping of paper rolls the problem is the bringing of the front end of the wrapper around the roll so, that it is neither wrinkled nor separated from the roll. As a consequence of this problem there are frequent interruptions on the roll wrapping line. It has been tried to solve the problem so, that before wrapping, the wrapper is provided with a glue layer, which however is a rather cumbersome procedure, since the glue sludge dryed on the devices may cause glue splashes to soil the surroundings. Due to the great amounts of glue needed, the use of the method becomes expensive and requires supervision. Besides, possible loose layers in the roll hamper the glueing of the first wrapper layer onto the surface of the roll to be packed, and hence, it has not been possible to completely eliminate said problem. On the other hand, a solution has been searched for by placing, at different sides of the roll being wrapped several guide straps guiding the wrapper a short distance. These solutions will be complicated and expensive and in spite of that there will be problems in the guiding of the wrapper, because short straps are not able to follow the surface of a roll well enough, especially not when the roll size varies.

The object of the invention is to provide such an arrangement for wrapping paper rolls or the like, that bringing of the front end of the wrapper around the roll takes place most reliably, regardless of variations in roll size so that no unnecessary interruptions delaying the entire roll handling are caused during the wrapping of the roll. The characteristic features of the invention are evident from the characterizing part of claim 1. In an arrangement according to the invention wrapping of a roll and bringing of the front end of the wrapper around the roll take place in a plain manner and well controlled, since it is possible to guide the travel of the front end of the wrapper over a considerably longer distance than in known wrapping devices.

For securing the guiding of the wrapper the guide strap is arranged to settle tightly on the roll. This may be carried out by using an elastic guide strap, but also other means, known per se, such as, for instance, movable pulleys may be employed. The guide strap may be made of, for instance, polyester or rubber. The width of the guide strap may be 20 to 80 millimeters, preferably 30 to 50 millimeters.

In a preferred embodiment of the invention the pulling device comprises two parallel chains, which partly, preferably over half the chain length, are combined with crossbars for supporting the guide strap. When the chains are in their initial position, their portion including crossbars is at the inside of the support frame. For obtaining guiding action of the guide strap the chains are moved so, that the crossbars move to an outer portion of the support frame, whereby the guide strap settles on the roll between the chains. A condition is, of course, that the guide strap is narrower than the distance between the chains.

If the support system of the roll to be wrapped comprises support rolls, the guide strap can be arranged to run around one support roll, which may rotate both the guide strap and the roll being wrapped. For preventing the front end of the wrapper from sliding down between the support rolls, a separate additional guide strap may be arranged between the support rolls. For this purpose also a blowing device located between the support rolls may be used.

In order to make it possible to bring, at the end phase of the wrapper guiding, the guide strap and the front end of the wrapper along the mantle surface of the roll being wrapped as close as possible to the supply point of the wrapper, a movable guide member for the guide strap may be arranged at the supply side of the roll being wrapped, which member is preferably connected to a power cylinder.

For rolls of different lengths the wrapping arrangement may comprise two or more pulling means placed one after another in the axial direction of the roll being wrapped and guide straps functionally connected to said pulling means. For reducing the number of pulling means needed at least one pulling means with its guide straps may be arranged to be movable in the axial direction of the roll being wrapped.

The arrangement is also provided with means for moving the roll in its axial direction to the wrapping position and away therefrom.

Said roll moving means may be placed between the support rolls. During wrapping of the roll said means may be moved away from their roll transferring position, for instance, by lowering them to a lower level between the support rolls. Then the roll transfer means may preferably comprise a set of transfer rolls, which have a concave middle portion, so that when lowered to a level lower than the roll transferring position, said set of rolls is arranged to guide the wrapper being supplied between the roll and the guide strap.

Figure 1:
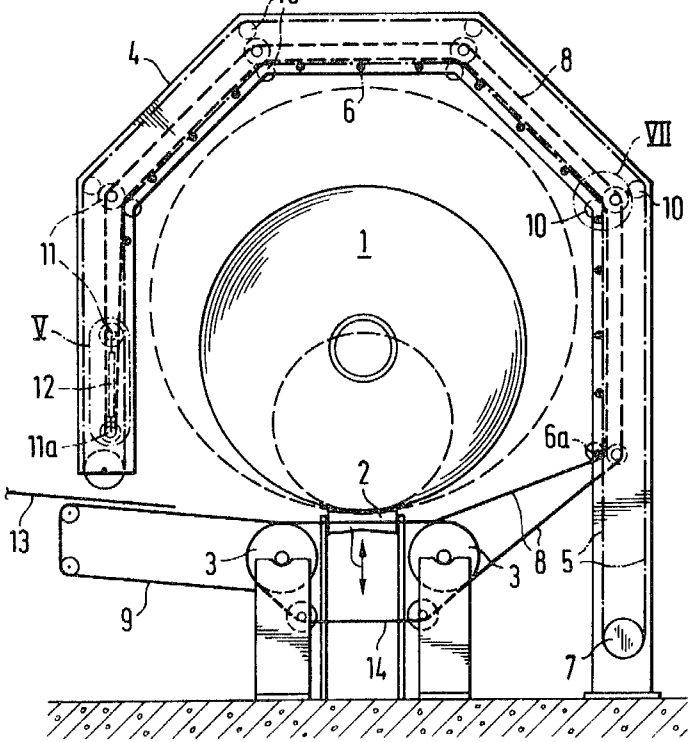
Figure 4:
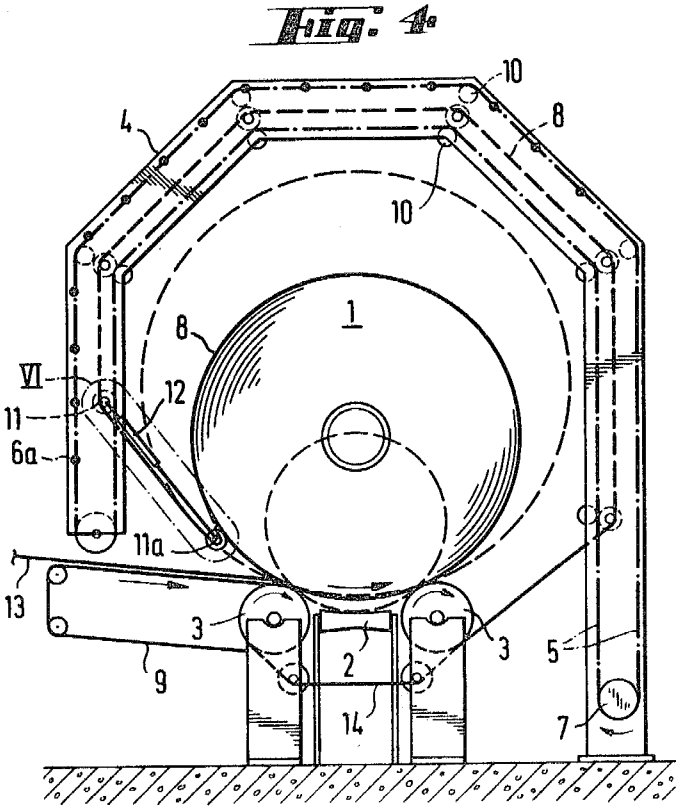

In the following, the invention is described more in detail, with reference to the attached drawing, in which FIGS. 1 to 4 schematically show an arrangement according to the invention seen in the axial direction of the roll, FIG. 5 shows part V of FIG. 1 on a larger scale, FIG. 6 shows part VI of FIG. 4 on a larger scale, FIG. 7 shows a top view of part VII of FIG. 1 on a larger scale, and FIG. 8 shows wrapper arrangement according to the invention seen from the side of the roll mantle surface.

In the drawing, reference numeral 1 indicates a roll being wrapped, which is transferred to the wrapping station by means of a set of transfer rolls 2. During the wrapping, roll 1 is supported by support rolls 3. The wrapper arrangement also comprises a support frame 4, carrying by means of chain wheels 10 a reciprocating pulling device, driven by a conventional reversible motor 7 and comprising parallel chains 5 and crossbars 6 combining partly said chains, on which crossbars, bushings 15 are journalled. In the support frame, there is arranged a guide strap 8 for the wrapper 13 supported by guide members 11. A turnable power cylinder 12 is connected to a movable guide member 11*a*. For the feeding of wrapper 13 the arrangement also comprises a pulling strap 9 and a second guide strap 14. In the following, the function of the arrangement and the bringing of wrapper 13 around the roll 1 is explained with reference to FIGS. 1 to 4.

When roll 1 is transferred to the wrapping station by means of transfer rolls 2, those of said rolls being at the wrapping station are lowered slightly between the support rolls 3, so that the roll moves to be supported by support rolls 3 (see FIGS. 1 and 2). The supply of wrapper 13 to the wrapping station is carried out by means of pulling strap 9. The actual wrapper roll and its functional devices are not shown in the drawing, since they do not fall within the scope of the invention and since earlier known solutions are suitable for this purpose. In order to prevent the front end of the wrapper from getting between support rolls 3, there is in the arrangement a second guide strap 14 running around the support rolls. For the same purpose the transfer rolls 2 can be made somewhat concave at their middle portion and further a blowing device (not shown in the drawing) may be arranged between support rolls 3 in order to press the front end of the wrapper against the mantle of roll 1 and to guide it between roll 1 and guide strap 8 of the wrapper. All said means do not necessarily have to be used in the same arrangement, one may chose only one of them or apply a suitable combination.

Figure 3:
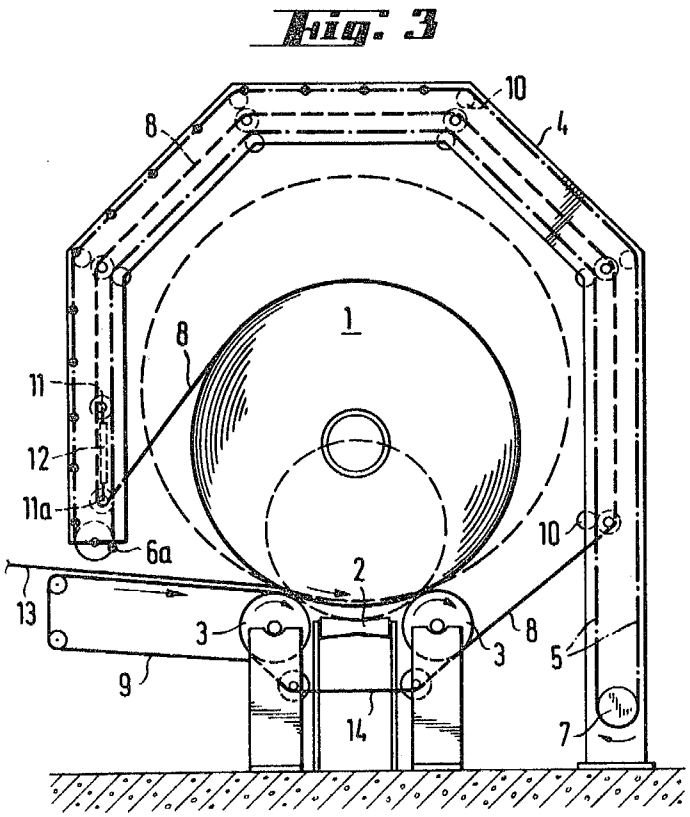

When the arrangement is in its initial position (FIG. 1), the part of the pulling device containing crossbars 6 is at the inner side of support frame 4 so, that the crossbars support a portion of guide strap 8. Hence, guide strap 8 will not be able to settle on roll 1. When the front end of wrapper 13 has been guided between roll 1 and guide strap 8, the pulling device is moved by means of motor 7, so that crossbars 6 come to the outer side of support frame 4 (FIGS. 2 to 4). Thereby, as the last crossbar 6*a*, which bends away guide strap 8 from roll 1, moves forward, guide strap 8 is able to settle on roll 1 and wrapper 13 is wound around the roll between the roll and the guide strap when the roll is rotated, as shown in FIGS. 2 and 3. When the last crossbar 6*a* has moved past guide member 11*a* of guide strap 8 (FIG. 3), said guide member 11*a* is moved by conventional pivoting means for movement of power cylinder 12 against the mantle of the roll 1 close to the supply point of package wrapper 13, as shown in FIG. 4. The function of guide member 11*a* and power cylinder 12 is more clearly shown in FIGS. 5 and 6, in which the moving directions of power cylinder 12 are represented by arrows. By the manner disclosed, wrapper 13 is easily and certainly brought around roll 1, since the front end of the wrapper can be guided practically over the whole distance.

After bringing the front end of package wrapper 13 being, around roll 1, guide member 11*a* may be moved back by conventional means not shown as also the pulling device to be ready for wrapping the next roll.

The chains 5 reverse the movement of the bars 6 at the end of the wrapping operation which return along the inner side of the support frame to their original position.

When sufficiently many turns of wrapper 13 have been wound on roll 1, the wrapper supply is stopped, the wrapper is cut transversely and at the back end of the wrapper glue is spread for fixing the back end. After this, the rotating of the roll 1 is stopped, the lowered transfer rolls 2 are lifted up into their transfer position, and roll 1 is moved away from the wrapping station for further handling.

In FIGS. 1 to 4 some alternatives relating to other feasible roll diameters are shown with dotted lines. In practice, the diameter of the roll being wrapped can vary roughly between 600 and 1800 mm. A condition for using the same arrangement for rolls of different size is that support frame 4 is sufficiently large and that there is such a compensation of the length of guide strap 8, that the strap, regardless of the roll diameter, settles tightly enough on the roll. The compensation of the length of guide strap 8 may be carried out by means of an elastic strap of, for instance, polyester and rubber, by which a stretching of about 50% can be achieved and which also is very wear resistant, or by means of some compensating method known per se, for instance, movable pulleys or similar special solutions. Also by changing the shape of support frame 4 it is possible to influence the necessary compensation of the length of guide strap 8. A nearly circular shape of the support frame is the most favourable one from the compensation point of view. However, there is a disadvantage in the great number of chain wheels 10 and strap guide members 11 needed. On the other hand, the number of said members can be kept small in a rectangular support frame construction, but a greater compensation of the length of the guide strap 8 is needed.

In FIG. 7 the suspension of guide strap 8 and of chains 5 of the pulling device in support frame 4 by means of guide members 11 and chain wheels 10 is visualized. On crossbars 6 bushings 15 are so journalled, that the guide strap 8 is able to move along with the roll being wrapped, independently of chains 5.

The length of rolls 1 being wrapped may also vary considerably: from about 400 to 3000 mm. For this reason the arrangement may comprise two or more separate support frames 4 with pulling devices and guide straps 8, as shown in FIG. 8. By making one support frame movable in the axial direction of the roll the number of necessary support frames can be minimized. The actual guide strap 8 does not need to be very wide, already a guide strap with a width of about 30–50 mm gives sufficient guiding for package wrapper 13.

For lowering some of the transfer rolls 2 between the support rolls 3 constructions known per se can be used, and due to this they have not been shown in detail in the drawing.

The invention is not limited to the embodiments shown, but several modifications of thereof are feasible within the scope of the attached claims.

I claim:

1. An arrangement for wrapping big web rolls in a wrapper, which arrangement comprises a support system for supporting and rotating said roll and a stationary support frame surrounding said roll and being provided with means for leading said wrapper around said roll, said support frame being provided with a tension guide strap having a first portion in contact with the mantle surface of said roll and two parallel chains movable around the roll and interconnected over a portion with crossbars for applying said strap onto the mantle surface of said roll for keeping said wrapper on the mantle surface of said roll, at least some of said crossbars comprise a support means which supports a second portion of said guide strap at a distance from said roll against the tension of said strap urging it towards said roll, thereby causing said guide strap to bend off at a point between said first and said second portions from the mantle surface of said roll, said chains also having another portion free from crossbars following said crossbar portion of said chains, thereby allowing said guide strap to settle onto said roll from between said chains as said chains move around the roll, means to move said pair of parallel chains around said roll during the wrapping operation thereby to move said bending-off point of the guide strap around said roll and to cause an increasing portion of said guide strap to settle, due to its tension, onto the free mantle surface of said roll to bring the front end of said wrapper against the roll and to keep said wrapper closely thereon when rotating said roll during simultaneous feeding of the wrapper thereto and thereby wrap said roll.

2. A wrapping arrangement according to claim 1, in which said guide strap is arranged to exert positive pressure on said roll.

3. A wrapping arrangement according to claim 2, in which said guide strap is made of a material with elastomere characteristics such as polyester and rubber.

4. A wrapping arrangement according to claim 1, in which the width of said guide strap is 20 to 80 mm.

5. A wrapping arrangement according to claim 4, in which the width of said guide strap is 30 to 50 mm.

6. A wrapping arrangement according to claim 1, in which said support system of said roll comprises support rolls, said guide strap being arranged to run around one of said support roll, said support roll being arranged to rotate said guide strap as well as said web roll.

7. A wrapping arrangement according to claim 6, comprising a separate second guide strap carried by said support rolls for preveting the front end of said wrapper from falling down between said support rolls.

8. A wrapping arrangement according to claim 6, including upwardly directed blowing means placed between said support rolls.

9. A wrapping arrangement according to claims 1 or 2, in which there is, at the wrapper feeding side of said roll, a movable guide member for said guide strap, said guide member being movable close to said roll for bringing, at the end phase of the wrapper applying operation, said strap and the front end of said wrapper against the mantle surface of said roll at a point close to the roll support means.

10. A wrapping arrangement according to claim 1, comprising at least two of said operating means with corresponding guide straps, said operating means being placed one after another in the axial direction of said roll.

11. A wrapping arrangement according to claim 10, in which at least one of said operating means with its guide straps is movable in the axial direction of said roll.

12. A wrapping arrangement according to claim 1, comprising means for moving said roll in its axial direction to a position inside said support frame and out therefrom.

13. A wrapping arrangement according to claim 12, in which said roll moving means is located between said support rolls and is arranged to be moved away from its roll moving position for the time when said roll is being wrapped.

14. A wrapping arrangement according to claim 13, in which said roll moving means comprises a set of transfer rolls having a concave middle portion, for giving suitable wrapper guiding when being in a position slightly lower than its web roll moving position.

* * * * *